US005267402A

United States Patent [19]

Russell et al.

[11] Patent Number: 5,267,402

[45] Date of Patent: Dec. 7, 1993

[54] BUCKET ASSEMBLY FOR A TRACTOR

[76] Inventors: Lee A. Russell, Box 444; Gerald R. Sartain, Hwy. 41, both of Tracy City, Tenn. 37387

[21] Appl. No.: 977,547

[22] Filed: Nov. 17, 1992

[51] Int. Cl.[5] ..... E02F 3/00

[52] U.S. Cl. ..... 37/118 A; 37/DIG. 13; 37/103

[58] Field of Search ..... 37/103, 118 A, 118 R, 37/141 R, DIG. 13, 233; 172/817

[56] References Cited

U.S. PATENT DOCUMENTS

| | | | |
|---|---|---|---|
| 3,807,587 | 4/1974 | Maurer | 37/118 A X |
| 4,081,919 | 4/1978 | Teach | 37/103 |
| 4,523,397 | 6/1985 | Lucas | 37/118 R |
| 4,813,163 | 3/1989 | Livingston et al. | 37/103 |
| 4,963,071 | 10/1990 | Larwin et al. | 37/118 R X |
| 5,018,284 | 5/1991 | Mikami et al. | 37/233 |
| 5,123,185 | 6/1992 | Pollard | 37/118 A X |

*Primary Examiner*—Randolph A. Reese
*Assistant Examiner*—J. Russell McBee
*Attorney, Agent, or Firm*—Alan Ruderman

[57] ABSTRACT

A bucket assembly for a tractor has a plastic bucket in the form of a trough including a rear wall, a top wall, a bottom wall and a pair of end walls. A plurality of strengthening ribs having first and second legs are fastened to the bottom and rear walls of the bucket at respective legs. A mounting plate is fastened to three of the ribs at the rear wall and includes spaced apart rearwardly extending ears for connecting to the conventional bucket supporting arms and tilt cylinders of the tractor. A two piece cutting edge is attached to the ribs at the front of the bottom wall and projects forwardly of the bucket. The bucket also includes stiffeners upset out of the top wall and protective strips extending from the front of the end walls. By selection of the appropriate mounting plate the bucket assembly may be universally adapted for all of the known tractors.

18 Claims, 2 Drawing Sheets

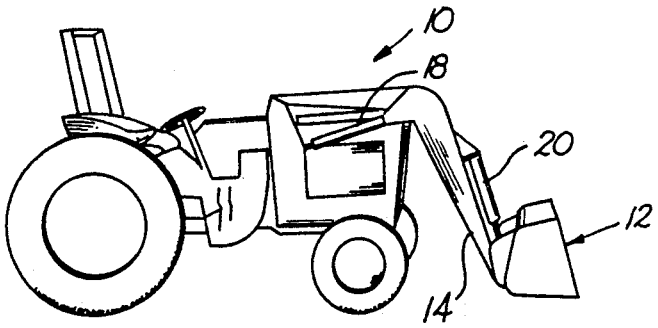
FIG. 1
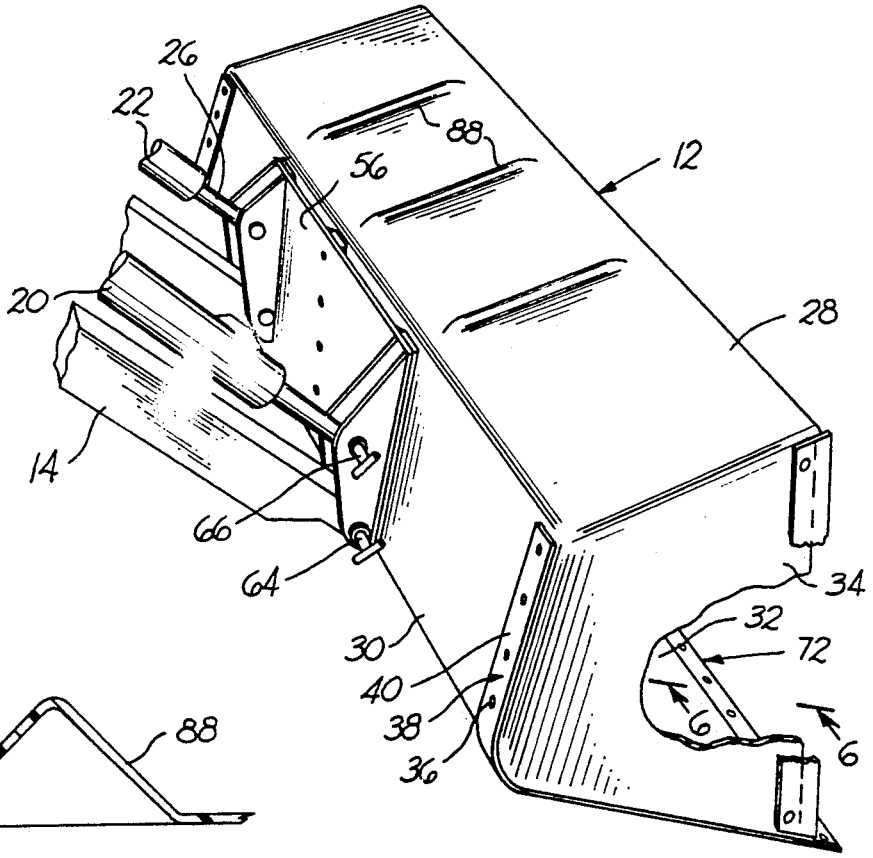
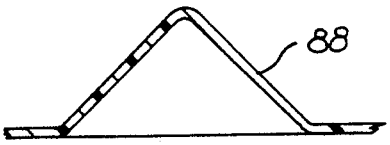
FIG. 4
FIG. 2
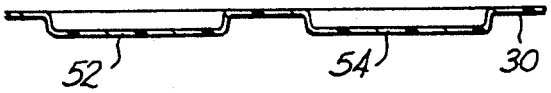
FIG. 5

BUCKET ASSEMBLY FOR A TRACTOR

BACKGROUND OF THE INVENTION

This invention relates to a bucket assembly for a tractor and more particularly to a bucket assembly of this type having a bucket constructed from plastic and having selectively replaceable mounting plates for universal adaptability of the bucket to different tractors and reinforced so as to possess sufficient strength for use on a farm or the like.

Tractors of the type used on a farm include a load carrying scoop or shovel, known as a bucket, pivotably supported by spaced bucket arms and tilt cylinders carried by the tractor. Conventionally, such buckets are constructed from steel and since they operate in corrosive or caustic environments, tend to rust and thereafter fail. Additionally, there is a large variation in the design of tractors on the market which tend to have different bucket arms and tilt cylinder spacings. The buckets have spaced apart ears or brackets to which the bucket arms and tilt cylinders are connected and when a bucket has to be replaced, the correct bucket must be obtained. The tractor owner is thus restricted to purchasing a new bucket from the tractor manufacturer. It is therefore highly desirable to provide a bucket which not only will not fail by rusting, but which also may be universally mountable on most any of the known tractors.

SUMMARY OF THE INVENTION

Consequently, it is a primary object of the present invention to provide a bucket assembly including a rust-free universal bucket adapted to be connected to the bucket arms and tilt cylinders of several different tractors, including those having variations in the spacing between such arms and cylinders.

It is another object of the present invention to provide a tractor loading bucket assembly including a bucket which is constructed from a material which does not rust or corrode, the bucket including a mounting plate secured thereto for connecting the bucket to a tractor, the plate having spaced ears or brackets selected to conform to the spacing between the tractor bucket arm and tilt cylinders.

It is a further object of the present invention to provide a bucket assembly including a plastic bucket for a tractor having strengthening ribs attached thereto, selected ribs supporting a mounting bracket, and the mounting bracket being selected to include ears or bracket members spaced apart by an amount corresponding to the spacing between the bracket arms and tilt cylinders of the tractor to which the bucket is to be mounted.

Accordingly, the present invention provides a bucket assembly having a plastic bucket for a tractor, the bucket having a rear wall, a top and a bottom wall connected to the rear wall, a pair of end walls closing the ends of the bucket and an open front through which a load may be received and discharged, the bucket assembly including a plurality of ribs fastened to the bottom and rear walls of the bucket. A mounting plate is fastened to at least one of the ribs at the rear wall and includes spaced apart rearwardly extending ears or bracket members for attachment to spaced apart bucket arms and tilt cylinders of the tractor. A plate having the appropriate spacing between the brackets corresponding to the arm and tilt cylinders spacing of a particular tractor may be selected for use of the bucket with the particular tractor so that the bucket is universally adapted for use with substantially all known tractors merely by selection of the mounting plate.

Another aspect of the invention is the provision of an additional replaceable two member cutting edge attached to the ribs at the bottom wall and projecting from the bottom front edge of the bucket while a protective strip may extend from the front of the end walls.

Thus, the present invention provides a non-corrosive, non-rusting bucket adapted for use with tractors having variations in the spacing between bucket arms and tilt cylinders merely by fastening the appropriate mounting plate to the bucket.

BRIEF DESCRIPTION OF THE DRAWINGS

The particular features and advantages of the invention as well as other objects will become apparent from the following description taken in connection with the accompanying drawings in which:

FIG. 1 is an elevational view depicting a tractor having a bucket assembly constructed in accordance with the principles of the present invention;

FIG. 2 is an enlarged perspective view of a bucket assembly of the present invention partly broken away and illustrating the attachment to the tractor;

FIG. 4 is a cross sectional view taken substantially along line 4—4 of FIG. 3;

FIG. 5 is a cross sectional view taken substantially along line 5—5 of FIG. 3.

DESCRIPTION OF THE PREFERRED EMBODIMENT

Figure 3:
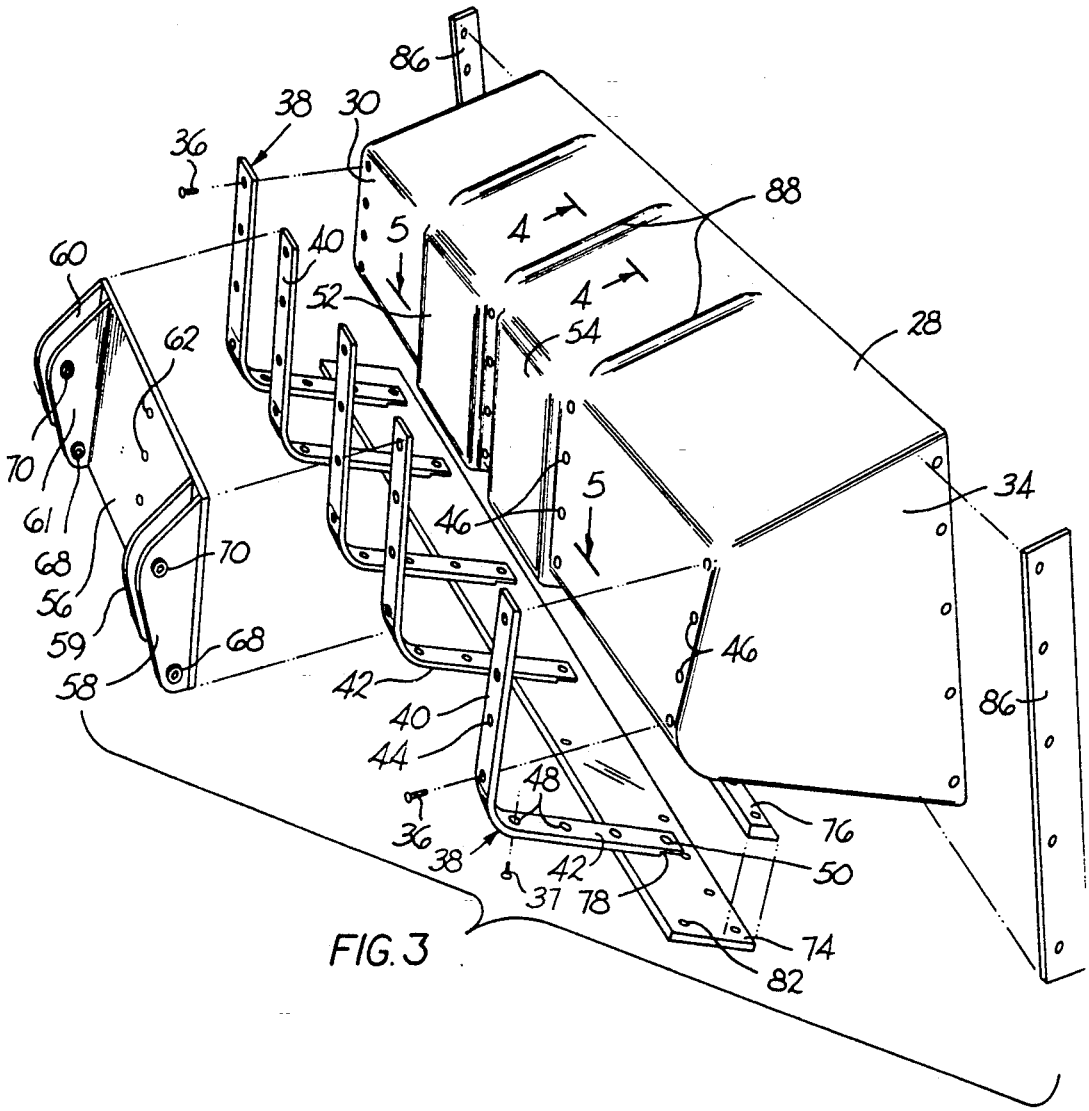
FIG. 3 is an exploded perspective view of the bucket assembly.

Referring to the drawings, FIG. 1 depicts a conventional tractor 10 of the type used on a farm or the like, the tractor including a bucket assembly having a bucket 12 constructed in accordance with the present invention. The bucket assembly is supported by bucket support arms 14, 16 best illustrated in FIG. 2 pivotably carried by the tractor and respectively driven by corresponding hydraulic cylinder means 18 (only one of which is illustrated). Pivotably carried by each arm 14, 16 is a hydraulic tilt cylinder 20, 22 having a respective rod 24, 26 extending from an end thereof, the rods being connected to the bucket assembly as hereinafter described. Conventionally, the bucket is constructed from steel and the bucket arms 14, 16 and tilt cylinder rods 24, 26 are pivotably connected to spaced apart pairs of steel ears or brackets welded to the bucket. Since the different brands of tractors have bracket arms and tilt cylinders spaced apart at the discretion of the manufacturer, the ear spacings vary among the brands. A replacement bucket must therefore be obtained from the manufacturer of the particular tractor. Additionally, since the buckets are steel, the buckets rust and must be replaced periodically.

In accordance with the present invention the bucket 12 is constructed from synthetic plastic such as polyethylene which is relatively strong and which may be molded to the desired configuration and, of course, does not rust or corrode. The configuration of the bucket conventionally comprises an open front trough shaped housing having a substantially trapezoidal cross sectional configuration including a top wall 28, a rear wall 30, a bottom wall 32 and a pair of end walls 34, only one of which is illustrated, interfacing with the top, rear and bottom walls at common edges, and closing the ends of the bucket.

Fastened to the rear and bottom walls by bolts or the like 36 so as to provide strength and rigidity to the bucket are a plurality of spaced apart ribs or skid members 38, preferably constructed from steel, each having a substantially L-shape configuration including an upstanding leg 40 and a bottom forwardly extending leg 42 corresponding to the shape and cross sectional configuration of the rear and bottom walls 30, 32 of the bucket. The rib members 38 have a plurality of bores 44 in the rear leg 40 aligned with corresponding bores 46 in the rear wall for receiving the bolts 36 while the bottom leg 42 includes a number of similar bores 48 for receiving bolts 37 similar to the bolts 36 for fastening to the bottom wall 32 of the bucket, and also includes a tapped hole 50 adjacent the front for reasons which will become apparent. Additionally, the rear wall 30, as best illustrated in FIG. 5, preferably includes a pair of spaced apart integral upsets or pads 52, 54 bulging rearwardly by an amount substantially equal to the thickness of the legs 40 of the ribs or skids 38, the spacing between the pads being substantially equal to the lateral width of the legs 40. Thus, when the ribs or skids 38 are fastened to the bucket, the rear or exterior surfaces of the legs 40 of the ribs are substantially planar with the rear surfaces of the pads 52, 54. Consequently, a mounting plate 56 having a planar front facing surface may abut three of the legs 40 and also abut the surfaces of the pads 52, 54.

The mounting plate 56, which preferably is constructed from steel, includes two pairs of spaced apart ears 58, 59 and 60, 61 respectively, welded to and extending from the rear surface of the plate, the ears of each pair being spaced apart for receipt of a respective one of the bucket support arms 14, 16 and a corresponding cylinder rod 24, 26. Additionally, each pair of ears is spaced apart from the other pair of ears by a predetermined amount corresponding to the spacing between bucket arms 14, 16 and cylinders 20, 22 of a selected one of a various tractors. Thus, for each tractor design there is a corresponding plate having the appropriate spacing between the respective pair of ears. That is, the buckets for the tractors are identical and only the appropriate mounting plate need be selected for connecting the bucket to a particular tractor. The mounting plate may be fastened to the bucket by means of the bolts 36 which extend through the bores 62 in the mounting plates 56 between the ear pairs and through the rear leg 40 of the central skid 38 disposed between the pads 52 and 54. Additional support may be provided by connecting other bolts 36 through bores disposed between the respective spaced ears 58, 59 and 60, 61 and through the legs 40 of the skids adjacent the central skid and the respective pads 52, 54. The bucket arms 14, 16 and cylinder rods 24, 26 are pivotably connected to the respective ear pair 58, 59 and 60, 61 by journal pins 64, 66 extending through bores 68, 70 in the ears and corresponding bores (not illustrated) in the bucket arms and cylinder rods respectively.

Figure 6:
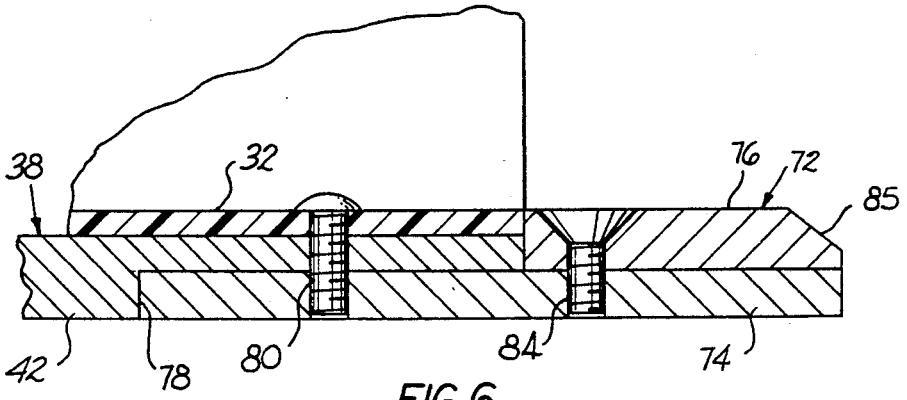
FIG. 6 is a cross sectional view, greatly enlarged, taken substantially along line 6—6 of FIG. 2.

In order to protect the plastic leading edge of the bucket, i.e., the bottom front edge, against damage when it rubs or digs into the ground during use of the bucket, the present invention provides protection preferably by means of a protective leading or cutting edge 72. Preferably, as illustrated in FIGS. 3 and 6, the cutting edge 72 is constructed from two steel members 74 and 76, the member 74 comprising a plate positioned within a notched recess or clearance 78 cut out of the lower surfaces of the legs 42 of the skids at the leading edges. The plates 74 are secured to the bucket and skids by respective screws 80 passing through a bore in the bottom wall 32 of the bucket and threaded into the tapped holes 50 in the front of the legs 42 and into respective tapped holes 82 in the plate 74. The second member 76, which if economically feasible may be formed integral with the plate 74, is fastened to the upper surface of the plate 74 abutting the leading edge of the bottom bucket wall 32 by means of a screw 84 threaded through the member 76 and into the plate 74. The upper leading edge of the member 76 if desired may have an inclined surface 85 for aiding in directing material to enter into the bucket during use.

Additional protective and strengthening means preferably are incorporated into the bucket assembly. For example, a steel protective strip 86 may be bolted to the front edge of each end wall 34, and stiffeners 88 may be upset out of the top wall 28 of the bucket during the molding process. Thus, although the bucket is constructed from plastic, it will have sufficient strength and rigidity for its intended use without requiring excessively thick walls.

Accordingly, a bucket assembly including a plastic bucket is provided which will not rust or corrode, which has the requisite strength and rigidity, and which may be readily usable with substantially all known tractors merely by selection of a mounting plate 56 having the proper ear spacing.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A bucket assembly for tractors having a pair of spaced apart support arms and a pair of equally spaced apart tilt cylinders for mounting said assembly to the tractor and tilting the assembly relative to the tractor, said assembly comprising a plastic bucket in the form of a trough having a rear wall, a top wall, a bottom wall, an open front for receiving and discharging a load, and a pair of end walls; a plurality of ribs each having first and second legs, said first leg of each rib having a forward facing surface being disposed for abutting the rear wall when the second leg abuts the bottom wall and a rearward facing surface; means for securing said ribs to said bucket in spaced apart disposition with the forward facing surface of each of said first legs abutting said rear wall and said second legs abutting said bottom wall; a mounting plate having front and rear surfaces; first and second spaced apart bracket means secured to said rear surface of said plate, the spacing between said bracket means being substantially equal to the spacing between the pair of support arms and the pair of tilt cylinders of said tractor for permitting one support arm and one tilt cylinder to be connected to each bracket means; means for connecting one support arm and one tilt cylinder to each bracket means; and means for fastening said plate to the first leg of at least one of said ribs with said front surface of said plate in abutment with the rearward facing surface and with said bracket means extending rearwardly.

2. A bucket assembly as recited in claim 1, wherein said bucket includes pad means projecting rearwardly from said rear wall of said bucket adjacent the first leg of said at least one rib, said pad means including rear surfaces upset out of said rear wall, said front surface of said plate abutting the rear surface of said pad means.

3. A bucket assembly as recited in claim 2, wherein said front surface of said plate is substantially planar.

4. A bucket assembly as recited in claim 2, including cutting edge means at the front of the bottom wall of said bucket, said cutting edge means comprising plate means fastened to the second legs of said ribs and having a portion extending forwardly relative to said ribs beyond the front of said bucket, said portion of said plate means having an upper surface substantially coplanar with the upper surface of said bottom wall.

5. A bucket assembly as recited in claim 4, wherein said front surface of said plate is substantially planar.

6. A bucket assembly as recited in claim 4, wherein said second legs include a step for receiving said plate means, said plate means having a lower surface substantially coplanar with surfaces of said second legs remote from said bottom wall.

7. A bucket assembly as recited in claim 4, wherein said plate means comprises two members, one of said members comprising a bottom plate fastened to said second legs of said ribs and the other of said members including an upper part of said portion, and means for securing said other member to said bottom plate.

8. A bucket assembly as recited in claim 7, wherein said second legs include a step for receiving said bottom plate, said bottom plate having a lower surface substantially coplanar with surfaces of said second legs remote from said bottom wall.

9. A bucket assembly as recited in claim 1, including cutting edge means at the front of the bottom wall of said bucket, said cutting edge means comprising plate means fastened to the second legs of said ribs and having a portion extending forwardly relative to said ribs beyond the front of said bucket, said portion of said plate means having an upper surface substantially coplanar with the upper surface of said bottom wall.

10. A bucket assembly as recited in claim 9, wherein said second legs include a step for receiving said plate means, said plate means having a lower surface substantially coplanar with surfaces of said second legs remote from said bottom wall.

11. A bucket assembly as recited in claim 9, wherein said plate means comprises two members, one of said members comprising a bottom plate fastened to said second legs of said ribs and the other of said members including an upper part of said portion, and means for securing said other member to said bottom plate.

12. A bucket assembly as recited in claim 11, wherein said second legs include a step for receiving said bottom plate, said bottom plate having a lower surface substantially coplanar with surfaces of said second legs remote from said bottom wall.

13. A bucket assembly as recited in claim 4, including protective strips secured to the front of said end walls and projecting forwardly beyond said front.

14. A bucket assembly as recited in claim 1, including stiffener means upset out of said top wall.

15. A bucket assembly as recited in claim 14, wherein said bucket includes pad means projecting rearwardly from said rear wall of said bucket adjacent the first leg of said at least one rib, said pad means including rear surfaces upset out of said rear wall, said first surface of said plate abutting the rear surface of said pad means.

16. A bucket assembly as recited in claim 14, including cutting edge means at the front of the bottom wall of said bucket, said cutting edge means comprising plate means fastened to the second legs of said ribs and having a portion extending forwardly relative to said ribs beyond the front of said bucket, said portion of said plate means having an upper surface substantially coplanar with the upper surface of said bottom wall.

17. A bucket assembly as recited in claim 16, wherein said bucket includes pad means projecting rearwardly from said rear wall of said bucket adjacent the first leg of said at least one rib, said pad means including rear surfaces upset out of said rear wall, said first surface of said plate abutting the rear surface of said pad means.

18. A bucket assembly as recited in claim 17, including protective strips secured to the front of said end walls and projecting forwardly beyond said front.

* * * * *